US005177551A

United States Patent [19]

Arnold

[11] Patent Number: 5,177,551

[45] Date of Patent: Jan. 5, 1993

[54] FUSING OIL APPLICATION METHOD AND APPARATUS

[75] Inventor: Daniel R. Arnold, Rochester, N.Y.

[73] Assignee: Eastman Kodak Company, Rochester, N.Y.

[21] Appl. No.: 759,359

[22] Filed: Sep. 13, 1991

[51] Int. Cl.[5] ..... G03G 15/20

[52] U.S. Cl. ..... 355/284; 355/282; 355/293

[58] Field of Search ..... 355/284, 282, 283, 293, 355/295; 118/60, 258, 256, 262, 264, 266, 268; 219/216; 222/422, 420, 187; 239/551, 76

[56] References Cited

U.S. PATENT DOCUMENTS

| | | | |
|---|---|---|---|
| 4,193,681 | 3/1980 | Tanigawa et al. | 118/60 X |
| 4,565,762 | 1/1986 | Kato | 430/99 |
| 4,751,548 | 6/1988 | Lawson | 219/216 X |
| 4,924,271 | 5/1990 | Brinton et al. | 355/284 |
| 4,942,433 | 7/1990 | Stuart | 355/284 |
| 5,043,768 | 8/1991 | Baruch | 355/284 |

*Primary Examiner*—A. T. Grimley
*Assistant Examiner*—T. A. Dang
*Attorney, Agent, or Firm*—Tallam I. Nguti

[57] ABSTRACT

Method and apparatus for applying fusing oil to the surface of a rotatable fuser roller of a fixing station includes a tube member that can be filled with fusing oil, and a plurality of small fusing oil releasing apertures formed through the wall of the tube member. The tube member is mounted non-rotatably against the surface of the fuser roller. The fusing oil applying apparatus also includes a solenoid assembly for compressing the tube member against the surface of the fuser roller to release fusing oil which forms a reservoir of such oil that is in contact with the fuser roller surface.

8 Claims, 2 Drawing Sheets

FUSING OIL APPLICATION METHOD AND APPARATUS

BACKGROUND OF THE INVENTION

This invention relates to fuser and pressure roller type fusing stations for fusing toner images in electrostatographic copiers and printers. More particularly, the invention relates to a method and apparatus for applying fusing oil to a toner image contacting surface of such a fusing station.

Fuser and pressure roller type fusing stations are well known for fusing toner images on a suitable receiver in electrostatographic copiers and printers. Usually the fuser roller of such stations is heated, and rotatably forms a fusing nip with a pressure roller. Receiver sheets carrying unfused toner images thereon can then be passed one at a time through such a fusing nip such that the surface of the heated fuser roller directly contacts and heats the toner images on each receiver sheet.

A common problem associated with such fusing stations is the undesirable offsetting of toner particles forming the toner images from the receiver sheet onto the surface of the fuser roller. Such offsetting of the toner particles results in poor image quality. In order to prevent such offsetting, it is well known to apply a toner release or fusing oil such as silicone oil, to the surface of the fuser roller.

Some of the various methods and apparatus for applying such oil to the surface of the fuser roller are disclosed, for example in U.S. Pat. No. 3,982,832 issued to Bendall et al. on Sep. 28, 1976, U.S. Pat. No. 4,393,804, issued to Nygard et al on Jul. 19, 1983, Great Britain Patent Specification No. 1,399,740, Published Jul. 2, 1975 and U.S. Pat. No. 4,994,862, issued Feb. 19, 1991 to Hoover. Typically, the apparatus disclosed each include a member for contacting and applying fusing oil to the fuser roller surface, and a supply source such as a replenishment bottle, for supplying fusing oil to the oil applying member. As such, the oil applying member becomes contaminated through- such contact and must occasionally be replaced. The supply source of oil frequently also has to be renewed. Furthermore, each such apparatus includes a separate and dedicated drive means, such as a motor, for powering the means for feeding the oil from the supply source to the oil applying member. Such apparatus are expensive, and are often difficult for ordinary operators to handle. In addition, the oil applying member by becoming contaminated can result in non-uniform oil application if not timely replaced.

SUMMARY OF THE INVENTION

It is an object of the present invention to provide a fuser and pressure roller type fixing station for use in an electrostatographic reproduction apparatus wherein the fusing station employs a relatively inexpensive method and apparatus for applying fusing oil in a substantially uniform manner to the fuser roller.

In accordance with the present invention, an apparatus is provided for applying fusing oil to the surface of a rotatable fuser roller of a fixing station of an electrostatographic reproduction machine. The fusing oil applying apparatus comprises a tube member for holding a supply of fusing oil. The tube member has first and second ends, and a radially compressible tube wall. The fusing oil applying apparatus also comprises a small aperture, formed through the compressible tube wall, for releasing a quantity of fusing oil from a supply of fusing oil within the tube member. The fusing oil applying apparatus further comprises means for non-rotatably mounting the tube member against the surface of the fuser roller, and means for compressing the tube member radially against the surface of the fuser roller. The tube member is mounted such that the small fusing oil release aperture is exposed against the surface of the fuser roller.

BRIEF DESCRIPTION OF THE DRAWINGS

In the detailed description of the invention presented below, reference will be made to the drawings, in which.

DETAILED DESCRIPTION OF THE PRESENT INVENTION

Figure 1:
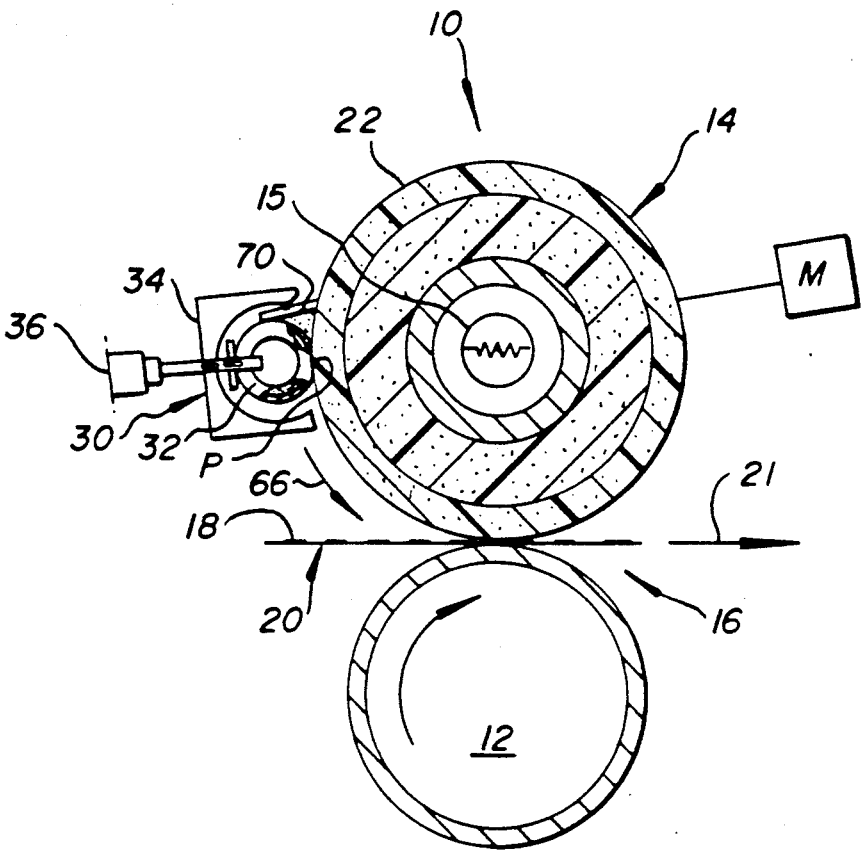
FIG. 1 is an end section of the fixing station of the present invention including a fuser roller and the fusing oil applying apparatus of the present invention.

Referring now to FIG. 1, a heat and pressure roller-type fixing apparatus is illustrated generally as 10. The fixing apparatus 10 includes a rotatable pressure roller 12 which may be unheated, and a rotatable fuser roller 14. The fuser roller 14 is heated, for example, internally by a heat source such as a lamp 15. As is well known, the fuser roller 14 can also be heated externally, for example, by a heated roller (not shown). The pressure and fuser roller 12, 14, respectively, form a fixing nip 16. When used in an electrostatographic reproduction apparatus such as a copier or printer, the fixing apparatus 10 can fuse and fix toner images 18 being carried on a suitable receiver sheet 20. The receiver sheet 20 as shown can be fed through the nip 16 in the direction of the arrow 21 by the rollers 12 and 14 rotating as illustrated. As can be seen, the toner images 18 are directly contacted by the heated fuser roller 14 during such fusing.

One problem associated with such contact involves new toner particles, which make up the toner images 18, undesirably offsetting from the receiver sheet 20 onto the surface 22 of the fuser roller 14. In order to prevent such undesirable offsetting of toner particles onto the surface 22, toner release or fusing oil is supplied and applied to such surface 22 by the fusing oil applying apparatus of the present invention shown generally as 30.

Figure 2:
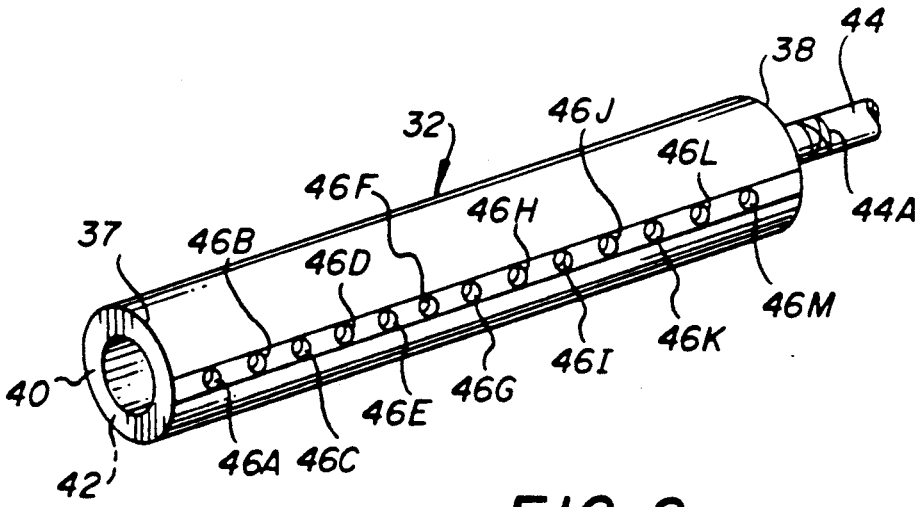
FIG. 2 is a perspective view of the tube member of the fusing oil applying apparatus of FIG. 1 including a row of fusing oil releasing apertures therein.
Figure 3:
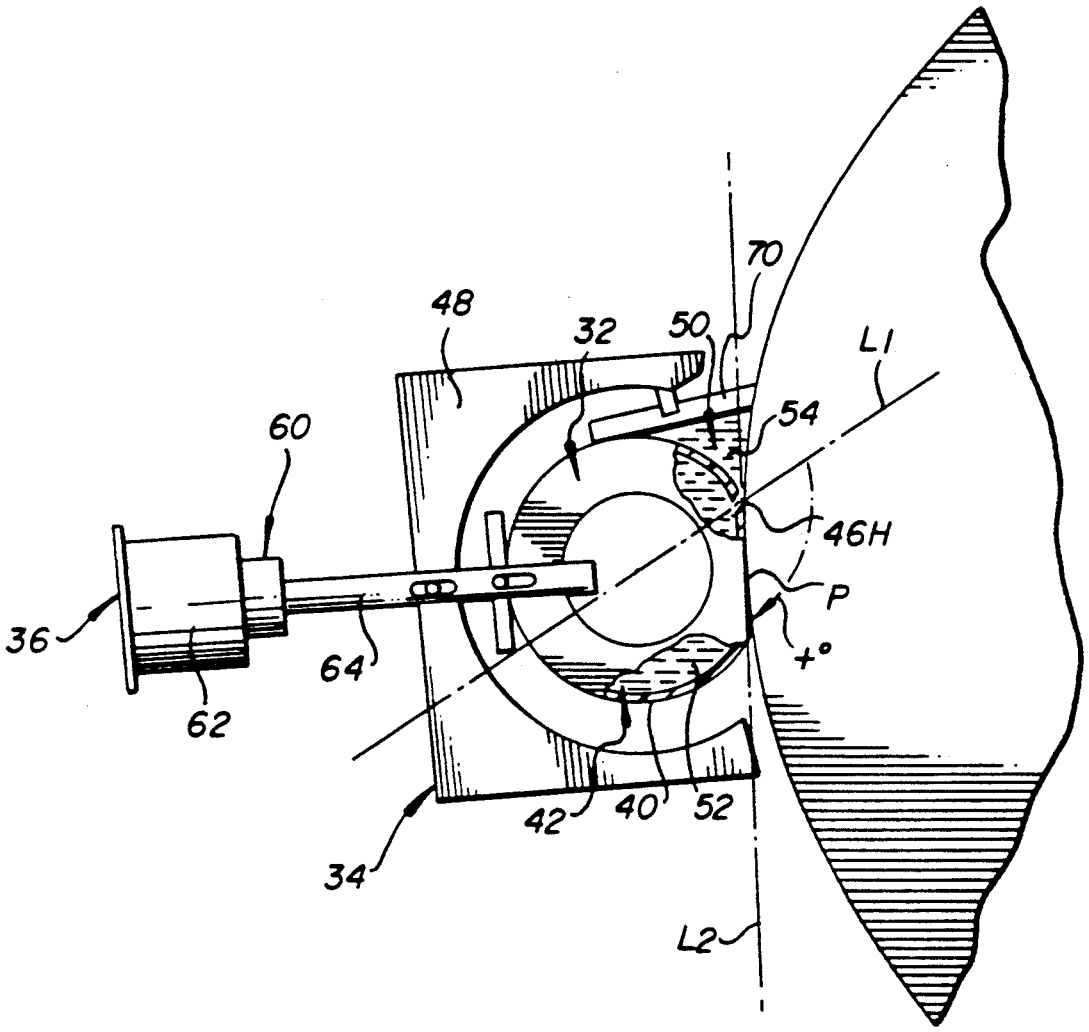
FIG. 3 is an enlarged view of the fusing oil applying apparatus of FIG. 1.

Referring now to FIGS. 1 and 2, the fusing oil applying apparatus 30 comprises a tube member 32 for holding a supply of fusing oil, means including a housing 34 for mounting the tube member 32 against the fuser roller surface 22, and means shown as 36 for compressing the tube member 32 against the surface 22. The tube member 32 has a first end 37, a second end 38, and a radially compressible tube wall 40 defining a tube cavity 42 within. As shown, the first end 37 is sealed, and the second end 38 includes tubular means 44 in communication with the tube cavity 42 through which fusing oil is fed into such cavity 42. A valve 44A may be added to shut off the supply of oil and to achieve a confined volume of such oil within the cavity 42.

As further shown, the fusing oil applying apparatus 30 comprises at least a small aperture 46H that is formed through the tube wall 40 and communicating with the tube cavity 42. As such, fusing oil from within the cavity 42 can be released through the aperture 46H to the outside of tube member 32. Preferably, the tube member 32 includes a plurality of such fusing oil releasing apertures 46A, 46B, 46C to 46M which are formed in a single row from the first end 37 towards the second end 38.

As shown, the mounting means 34 includes a housing 48 which substantially encloses the tube member 32. The mounting means 34 can be any conventional means suitable for mounting the tube member 32 non-rotatably into contact at a desired point P against the surface 22 of the fuser roller 14. The tube member 32 is mounted in contact as such so that the fusing oil releasing apertures 46A to 46M are unblocked by such contact. Additionally, the tube member 32 is mounted in contact as such so that the oil releasing apertures 46A to 46M are situated immediately upstream of the contact point P relative to the direction of rotation of the fuser roller 14. As such, the unblocked apertures 46A to 46M are situated in a lap area 50 between the surface of the tube member 32 and the surface 22. The point of contact P should lie gravitationally below the location of the apertures 46A to 46M. The tube member 32 is mounted correctly if a line LL drawn through the apertures 46A to 46M and the center of the tube member 32 forms a top front side angle X° of greater than 90° with a tangent line TL through the point of contact P.

The fusing oil applying apparatus 30 further comprises means shown generally as 36 for pressurizing a quantity of oil 52 that is contained within the cavity 42 of the tube member 32. The tube member 32 is made such that it can contain or hold such a quantity 52 of fusing oil which freely fills the cavity 42 between the first end 37 and the second end 38. As shown, the means 36 for pressurizing such a quantity 52 of fusing oil can comprise means 60 for compressing the tube wall 40 of tube member 32 radially against the contacting surface 22 of the fuser roller 14. The tube compressing means 60 may, for example include an electrically actuatable solenoid 62 that is connected to the housing 48 and to the tube member 32 by means of a plunger 64 and a pressing plate 65. As shown, the plunger 64 can, for example, be slotted for mounting movably over corresponding pin members on the housing 48 and pressing plate 65 respectively. Solenoid 62 when actuated moves the pressing plate 65 into the tube member 32 thereby compressing or further compressing the tube wall 40 against the surface 22. Such compression reduces the size of the filled cavity 42 thereby pressurizing the quantity 52 of fusing oil therein.

Pressurizing the quantity 52 of fusing oil by compressing the tube wall 40 or by other suitable means causes a small quantity of such fusing oil to be released through-. the apertures 46A to 46M into the lap area 50 forming a reservoir 54 of such oil. The reservoir 54 accordingly is also situated upstream of the point of contact P between the tube member 32 and the surface 22. The tube member 32 should be mounted against the surface 22 with a force sufficient ordinarily to create a seal of the point P in order to prevent the oil forming the reservoir 54 from gravitationally leaking to a point downstream of the point of contact P.

During a run mode when the fixing station or mechanism 10 is fixing images 18 on receiver sheets 20, the fuser roller 14 is, of course, being rotated by suitable drive means such as a motor M in the direction for example of the arrow 66. Rotation of the roller 14 as such brings each segment of its surface 22 first into cleaning contact with a cleaning element 70 that is mounted upstream of the reservoir 54 for removing paper and other particles in a conventional manner from the surface 22. The cleaned segment of the surface 22 then rotates through oiling contact with oil in the reservoir 54 and then through the sealing contact at point P with the compliant or compressible tube wall 40. Rotating the oiled surface segment through the point P as such squeegees and uniformly coats a desired amount of oil left on such segment over such segment of the surface 22. The squeegeeing action also serves to further clean the surface 22 of even very minute particles which can become suspended harmlessly for a long time in the reservoir 54.

During an idle mode when the fixing station is not running and the fuser roller 14 is not rotating, the solenoid 62 can be deactuated thereby allowing the tube wall 40 to resume its pre-compression contact state. In such a state, the tube wall 40 still forms an oil seal with the surface 22, but the cavity 42 is expanded thereby creating a state of negative pressure therein. Such a state of negative pressure causes the small sucked back into the cavity 42 of the tube member 32 until the next run mode.

As can be seen, the present invention provides a fixing station or mechanism that includes a relatively inexpensive but effective apparatus for uniformly and cleanly applying fusing oil to the surface of a fuser roller.

The invention has been described in detail with particular reference to a presently preferred embodiment, but it will be understood that variations and modifications can be effected within the spirit and scope of the invention.

What is claimed is:

1. Oil applying apparatus for applying toner release oil to a rotatable fuser roller in an electrostatographic fixing station, the oil applying apparatus comprising:

(a) a tube member having a radially compressible tube wall defining a cavity therein for holding a supply of such toner release oil;

(b) a plurality of small apertures formed through said compressible tube wall communicating with said cavity and suitably for releasing toner release oil from a supply thereof in said cavity; and (c) means for forming a reservoir of such toner release oil against the rotatable fuser roller, said means for forming the reservoir including mounting means for mounting said tube wall directly into sealing contact with the rotatable fuser roller such that said small apertures in said tube wall are unblocked by such sealing contact, and compressing means for compressing said tube wall radially against the rotatable fuser roller so as to release toner release oil from said cavity for forming the reservoir thereof against the rotatable fuser roller.

2. The oil applying apparatus of claim 1 including means for rotating the rotatable fuser roller through direct contact with toner release oil in the reservoir.

3. The oil applying apparatus of claim 1 wherein said tube member is mounted non-rotatably in such contact with the rotatable fuser roller.

4. The oil applying apparatus of claim 1 wherein said compressing means includes a pressing plate in direct contact with said compressible tube wall and an electrically activated solenoid for moving said pressing plate into said compressible tube wall.

5. The oil applying apparatus of claim 1 wherein said tube member is mounted such that relative to a direction of rotation of the rotatable fuser roller, said small apertures are located immediately upstream of a point of contact between said compressible tube wall and the rotatable fuser roller so as to allow toner release oil to freely release through said small apertures into said reservoir.

6. The oil applying apparatus of claim 1 wherein the rotatable fuser roller after rotating through direct contact with toner release oil in said reservoir is squeegeed by said compressible tube member in compressed contact therewith.

7. The oil applying apparatus of claim 1 including means for sucking a quantity of toner release oil from said reservoir through said small apertures back into said cavity of said tube member, said means for sucking the toner release oil including means for relaxing said compressible tube wall from compression against the rotatable fuser roller.

8. A fixing mechanism for fixing toner images on a suitable substrate in an electrostatographic reproduction machine, the fixing mechanism comprising:

(a) a heated fuser roller having an outside surface suitable for directly contacting and heating toner images being fixed;

(b) a pressure roller for forming a fixing nip with said fuser roller; and (c) apparatus for applying fusing oil to said outside surface of said fuser roller, the apparatus for applying fusing oil including:

(a) a tube member for holding a supply of fusing oil, said tube member having a radially compressible tube wall;

(b) a plurality of small apertures formed through said compressible tube wall for releasing fusing oil from a supply of such fusing oil within said compressible tube wall;

(c) means for mounting said tube member non-rotatably such that said compressible tube wall directly contacts said outside surface of the rotatable fuser roller and such that said small apertures are unblocked by such contact; and (d) means for compressing said compressible tube wall radially against said outside surface of the rotatable fuser roller.

* * * * *